US008960057B2

(12) United States Patent
Zeng

(10) Patent No.: US 8,960,057 B2
(45) Date of Patent: Feb. 24, 2015

(54) C-TYPE PLIERS

(71) Applicant: Min-Zheng Zeng, Nantou (TW)

(72) Inventor: Min-Zheng Zeng, Nantou (TW)

( * ) Notice: Subject to any disclaimer, the term of this patent is extended or adjusted under 35 U.S.C. 154(b) by 213 days.

(21) Appl. No.: 13/745,896

(22) Filed: Jan. 21, 2013

(65) Prior Publication Data

US 2014/0202291 A1 Jul. 24, 2014

(51) Int. Cl.
*B25B 27/20* (2006.01)

(52) U.S. Cl.
CPC ..... *B25B 27/205* (2013.01)
USPC ..... 81/302

(58) Field of Classification Search
USPC ..... 81/302, 342, 351, 416; 29/225, 229, 29/269
See application file for complete search history.

(56) References Cited

U.S. PATENT DOCUMENTS

| | | | | |
|---|---|---|---|---|
| 6,792,837 | B2 * | 9/2004 | Battistone | 81/302 |
| 6,983,677 | B1 * | 1/2006 | Engel | 81/302 |
| 7,194,936 | B2 * | 3/2007 | Engel et al. | 81/302 |
| 7,497,150 | B1 * | 3/2009 | Huang | 81/423 |
| 2005/0262973 | A1 * | 12/2005 | Yu | 81/302 |
| 2011/0214538 | A1 * | 9/2011 | Huang | 81/302 |

* cited by examiner

*Primary Examiner* — David B Thomas

(57) ABSTRACT

A C-type pliers contains a first elongated jaw including a first recess and a third recess, a second elongated jaw including a second recess and a fourth recess; a first handle further including a first notch, and a second handle including a second notch; a switching unit including a first cover, a second cover, a shaft extending outwardly from the second cover and used to drive the first cover and the second cover simultaneously, the shaft pivots the first handle, the second handle, the first elongated jaw, and the second elongated jaw; a switching unit also including a first retainer, a second retainer, when the first retainer retains in the first recess, the second retainer retains in the fourth recess simultaneously, and when the first retainer retains in the second recess, the second retainer retains in the third recess synchronously.

3 Claims, 7 Drawing Sheets

C-TYPE PLIERS

FIELD OF THE INVENTION

The present invention relates to a C-type pliers which switches a clamp direction and a unclamp direction of the first elongated jaw and the second elongated jaw quickly by using the switching unit so as to be applicable for the inner diameter and the outer diameter of the C ring, such that the user allows operating a single C-type pliers to clamp or unclamp C ring without using two different types of C-type pliers.

BACKGROUND OF THE INVENTION

Referring to FIG. 10, a convertible retaining ring pliers disclosed in U.S. Pat. No. 7,194,936 has a pivot, first and second jaws and first and second handles rotatably secured about the pivot. A pair of transfer pins is slidably disposed for selective movement in the jaws and the handles for establishing alternative operating positions enabling the jaws to move either inwardly or outwardly as the handles move inwardly. A switching mechanism is provided for simultaneous shifting of the transfer pins in the jaws and the handles. The switching mechanism includes reaction member housing assemblies which are mounted on opposite ends of the pivot and disposed on opposite external surfaces of the handles. A switchplate structure is rotatably mounted for side-to-side movement about the pivot, and is slidably positioned between at least one reaction member housing assembly and the external surface of one of the handles. The switchplate structure is engagable with an internal portion and an external portion of the at least one reaction member housing assembly, and an end of one of the transfer pins.

However, the cover spaces apart from the movable switchplate, so the cover is connected with the movable switchplate complicatedly, thus having high production cost.

The present invention has arisen to mitigate and/or obviate the afore-described disadvantages.

SUMMARY OF THE INVENTION

The primary object of the present invention is to provide a C-type pliers which switches a clamp direction and a unclamp direction of the first elongated jaw and the second elongated jaw quickly by using the switching unit so as to be applicable for the inner diameter and the outer diameter of the C ring, such that the user allows operating a single C-type pliers to clamp or unclamp C ring without using two different types of C-type pliers.

Another object of the present invention is to provide a C-type pliers in which the first cover and the second cover drive the switching unit directly, thus assembling the C-type pliers easily so as to lower production cost further.

To obtain the above objective, a C-type pliers provided by the present invention contains:

a first handle, a second handle, a first elongated jaw, a second elongated jaw, and a switching unit; wherein the first elongated jaw and the second elongated jaw include two lower ends for pivoting with two head ends of the first handle and the second handle;

the first elongated jaw includes a first recess defined on a surface thereof and corresponding to the first handle, the second elongated jaw includes a second recess defined on a surface thereof and corresponding to the first handle, the first elongated jaw also includes a third recess defined on another surface thereof and corresponding to the second handle, the second elongated jaw includes a fourth recess defined on another surface thereof and corresponding to the second handle, such that when the first elongated jaw and the second elongated jaw clamp a workpiece at a certain travel, the first recess communicates with the second recess, and the fourth recess communicates with the third recess;

the first handle includes a first notch formed on a head end thereof so that as the first elongated jaw clamps with the second elongated jaw, the first notch communicates with either or both of the first recess and the second recess, and the second handle includes a second notch formed on a head end thereof so that as the first elongated jaw clamps with the second elongated jaw, the second notch communicates with either or both of the fourth recess and the third recess;

the switching unit includes a first cover for covering the first handle, a second cover for covering the second handle, a shaft extending outwardly from the second cover and used to drive the first cover and the second cover simultaneously, the shaft pivots the first handle, the second handle, the first elongated jaw, and the second elongated jaw;

the switching unit also includes a first retainer, disposed in the first cover, movably inserting through the first notch, and driven by the first cover so as to retain in the first recess or the second recess, the switching unit further includes a second retainer, disposed in the second cover, movably inserting through the second notch, and driven by the second cover so as to retain in the fourth recess or the third recess, when the first retainer retains in the first recess, the second retainer retains in the fourth recess simultaneously, and when the first retainer retains in the second recess, the second retainer retains in the third recess synchronously.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
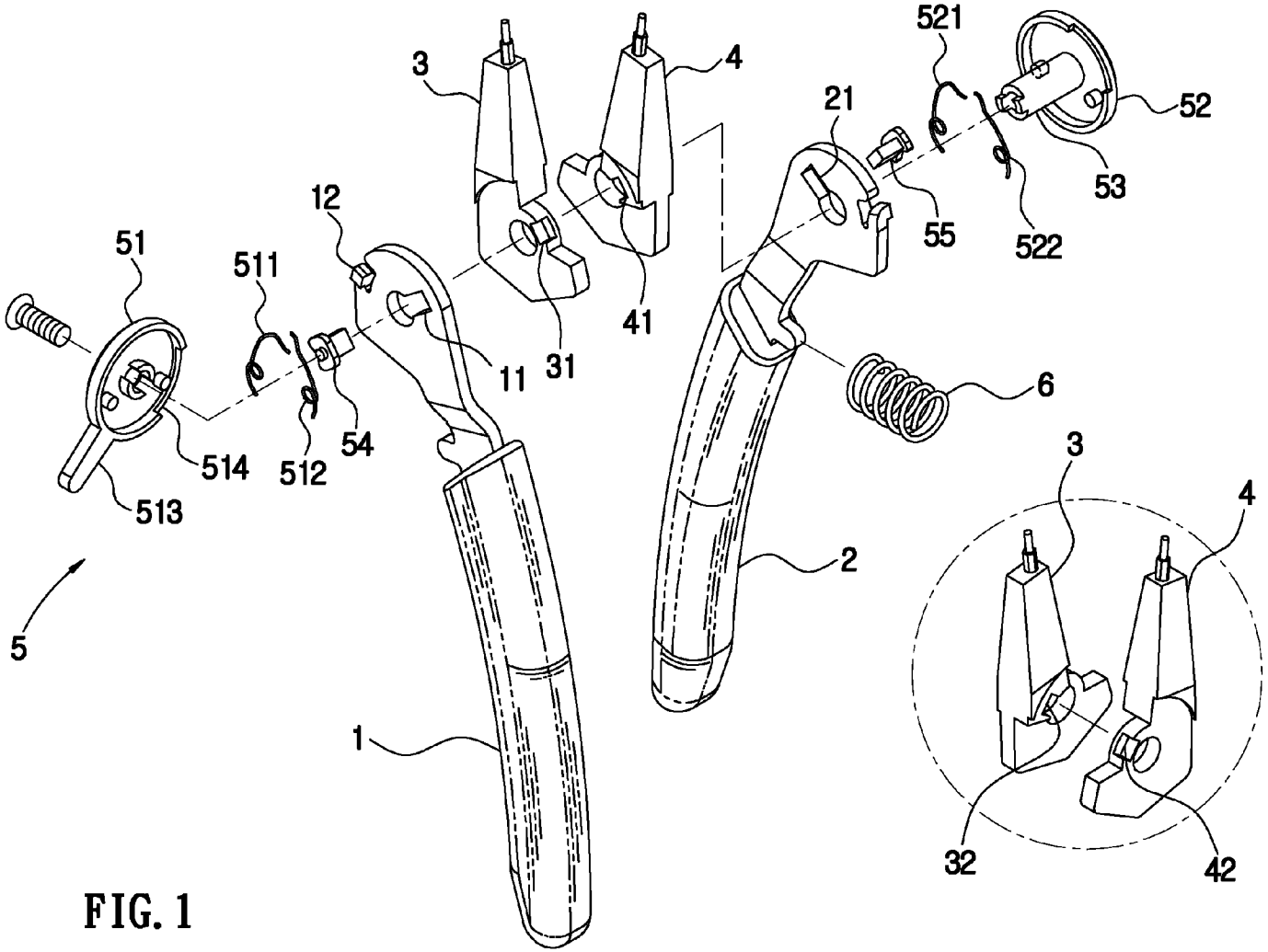
FIG. 1 is a perspective view showing the exploded components of a C-type pliers according to a preferred embodiment of the present invention.
Figure 2:
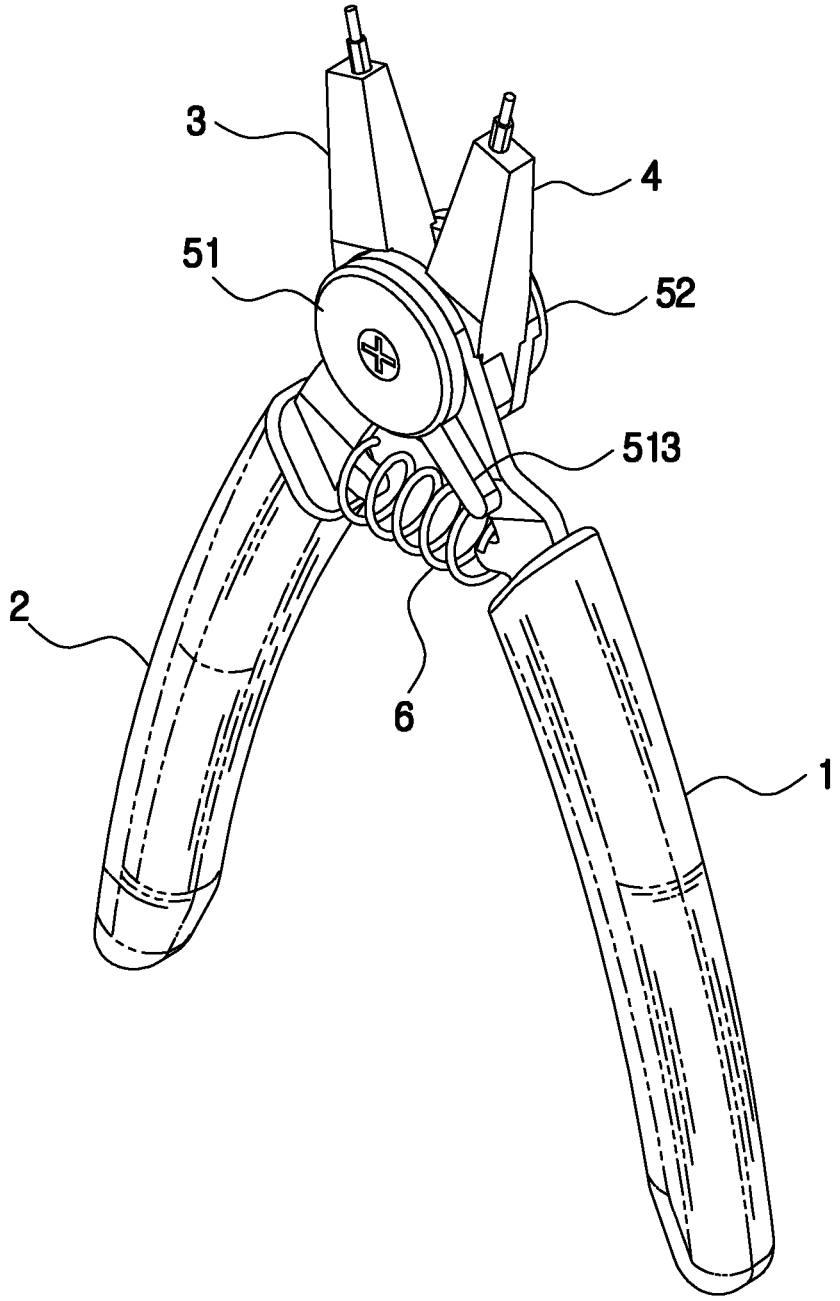
FIG. 2 is a perspective view showing the assembly of the C-type pliers according to the preferred embodiment of the present invention.
Figure 4:
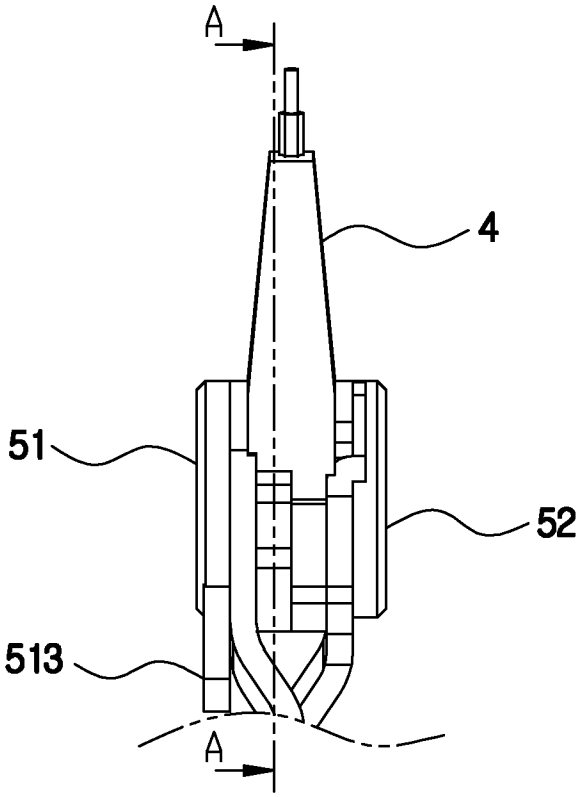
FIG. 4 is a cross sectional view of FIG. 3.

With reference to FIGS. 1-9, a C-type pliers according to a preferred embodiment of the present invention comprises a first handle 1, a second handle 2, a first elongated jaw 3, a second elongated jaw 4, and a switching unit 5.

The first elongated jaw 3 and the second elongated jaw 4 include two lower ends for pivoting with two head ends of the first handle 1 and the second handle 2;

The first elongated jaw 3 includes a first recess 31 defined on a surface thereof and corresponding to the first handle 1, the second elongated jaw 4 includes a second recess 41 defined on a surface thereof and corresponding to the first handle 1, the first elongated jaw 3 also includes a third recess 32 defined on another surface thereof and corresponding to the second handle 2, the second elongated jaw 4 includes a fourth recess 42 defined on another surface thereof and corresponding to the second handle 2, such that when the first elongated jaw 3 and the second elongated jaw 4 clamp a workpiece at a certain travel, the first recess 31 communicates with the second recess 41, and the fourth recess 42 communicates with the third recess 32.

The first handle 1 further includes a first notch 11 formed on a head end thereof so that as the first elongated jaw 3 clamps with the second elongated jaw 4, the first notch 11 communicates with either or both of the first recess 31 and the second recess 41. The second handle 2 further includes a second notch 21 formed on a head end thereof so that as the first elongated jaw 3 clamps with the second elongated jaw 4, the second notch 21 communicates with either or both of the fourth recess 42 and the third recess 32.

The switching unit 5 includes a first cover 51 for covering the first handle 1, a second cover 52 for covering the second handle 2, a shaft 53 extending outwardly from the second cover 52 and used to drive the first cover 51 and the second cover 52 simultaneously. In addition, the shaft 53 pivots the first handle 1, the second handle 2, the first elongated jaw 3, and the second elongated jaw 4.

The switching unit 5 includes a first retainer 54, disposed in the first cover 51, movably inserting through the first notch 11, and driven by the first cover 51 so as to retain in the first recess 31 or the second recess 41. The switching unit 5 also includes a second retainer 55, disposed in the second cover 52, movably inserting through the second notch 21, and driven by the second cover 52 so as to retain in the fourth recess 42 or the third recess 32. In addition, when the first retainer 54 retains in the first recess 31, the second retainer 55 retains in the fourth recess 42 simultaneously. And when the first retainer 54 retains in the second recess 41, the second retainer 55 retains in the third recess 32 synchronously.

Thereby, when the first retainer 54 and the second retainer 55 are switched to retain in the first recess 31 and the fourth recess 42, the first handle 1 drives the first elongated jaw 3, and the second handle 2 drives the second elongated jaw 4, such that the first handle 1 presses the second handle 2, and the second elongated jaw 4 and the first elongated jaw 3 are in a clamping state. Furthermore, when the first retainer 54 and the second retainer 55 are switched to retain in the second recess 41 and the third recess 32, the first handle 1 drives the second elongated jaw 4, and the second handle 2 drives the first elongated jaw 3, such that the first handle 1 presses the second handle 2, and the second elongated jaw 4 and the first elongated jaw 3 are in a unclamping state.

Further, the C-type pliers of the present invention also comprises a spring 6 mounted between the first handle 1 and the second handle 2 so as to abut against the first handle 1 and the second handle 2, such that the first handle 1 spaces apart from the second handle 2.

The switching unit 5 also includes a first outer spring 511 and a first inner spring 512 fixed in the first cover 51, such that a section of the first outer spring 511 is biased against the first retainer 54 as the first cover 51 rotates toward one side by which the first retainer 54 is pushed into the first recess 31, and a section of the first inner spring 512 is biased against the first retainer 54 as the first cover 51 rotates toward another side by which the first retainer 54 is pushed into the second recess 41.

The switching unit 5 further includes a second outer spring 521 and a second inner spring 522 secured in the second cover 52, such that a section of the second outer spring 521 is biased against the second retainer 55 as the second cover 52 rotates toward one side by which the second retainer 55 is pushed into the fourth recess 42, and a section of the second outer spring 521 is biased against the second retainer 55 as the second cover 52 rotates toward another side by which the second retainer 55 is pushed into the third recess 32.

Moreover, the first cover 51 has a switch bar 513 extending outwardly therefrom so that the switching unit 5 is switched easily by ways of the switch bar 513.

The first handle 1 further includes a rib 12 formed on the head end thereof, and the first cover 51 has a limiting slot 514 for matching with the rib 12 so as to limit a rotation range of the first handle 1.

Figure 3:
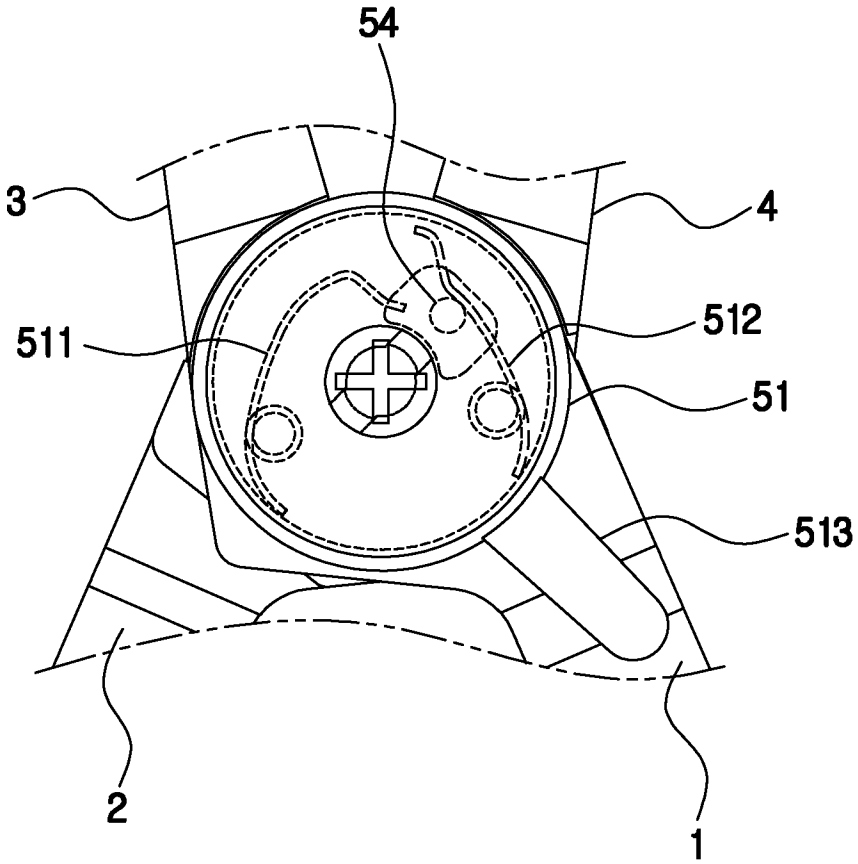
FIG. 3 is a plan view showing the operation of the C-type pliers according to the preferred embodiment of the present invention.
Figure 6:
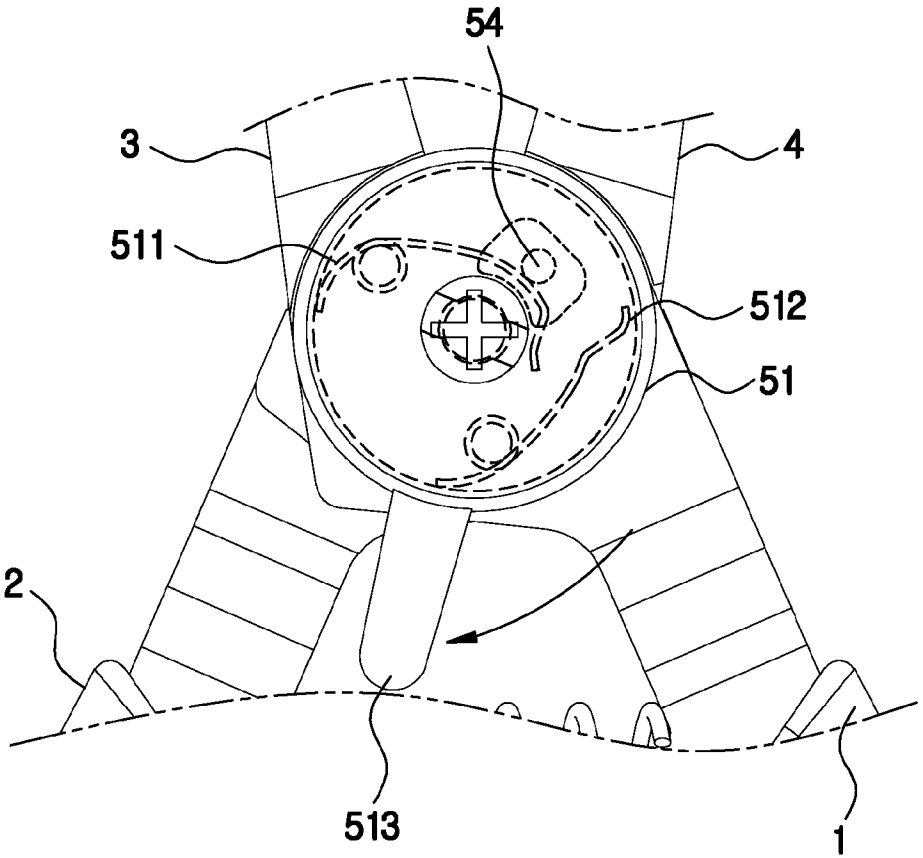
FIG. 6 is another plan view showing the operation of the C-type pliers according to the preferred embodiment of the present invention.
Figure 5:
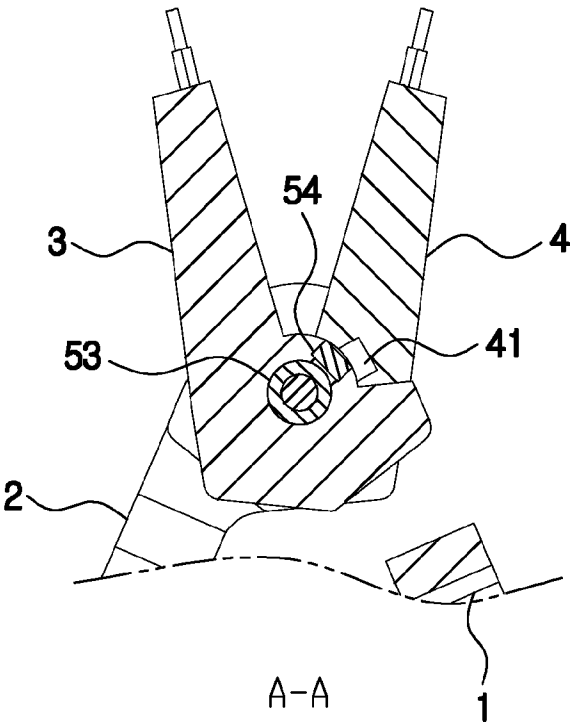
FIG. 5 is a cross sectional view taken along the lines A-A of FIG. 4.
Figure 8:
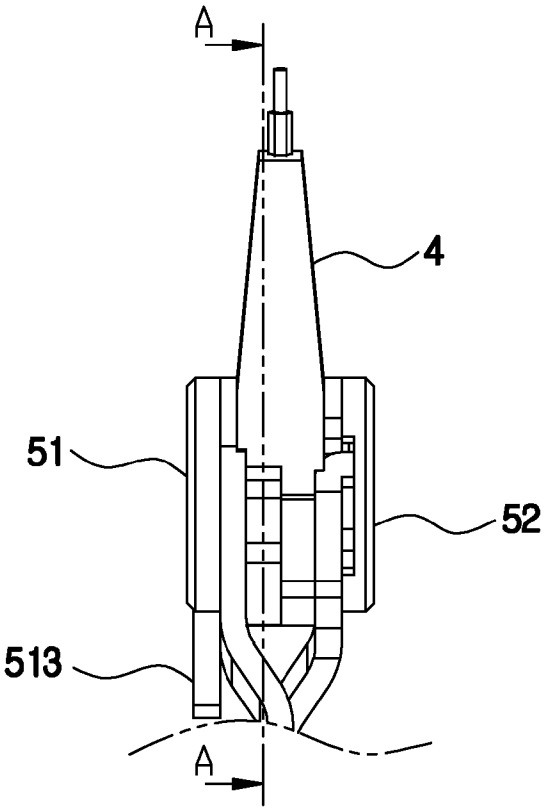
FIG. 8 is a cross sectional view of FIG. 7.
Figure 7:
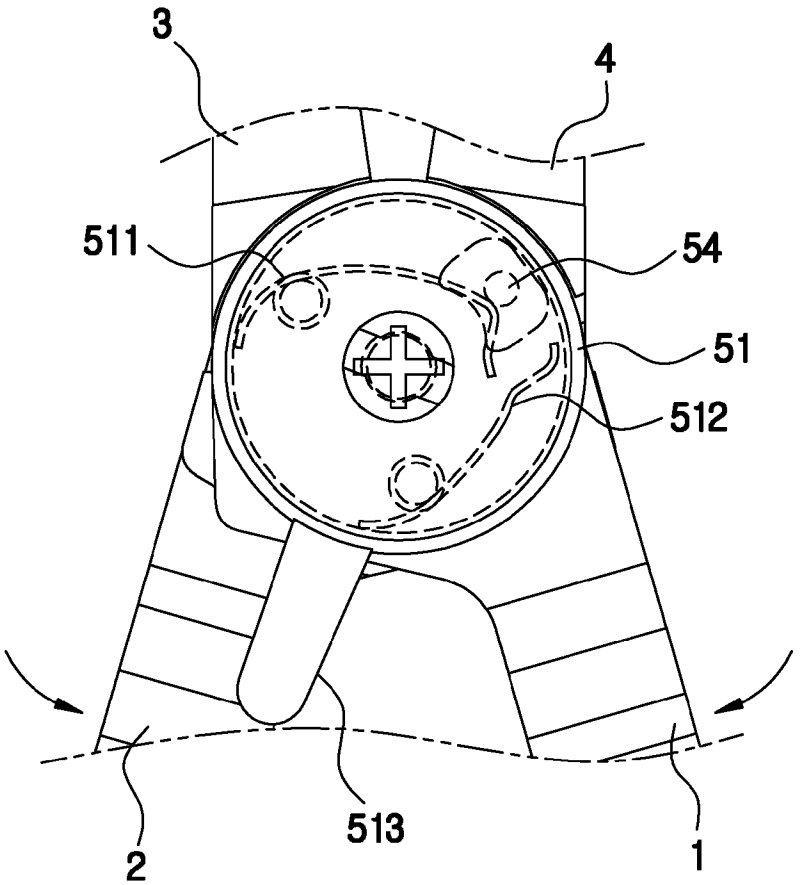
FIG. 7 is also another plan view showing the operation of the C-type pliers according to the preferred embodiment of the present invention.
Figure 9:
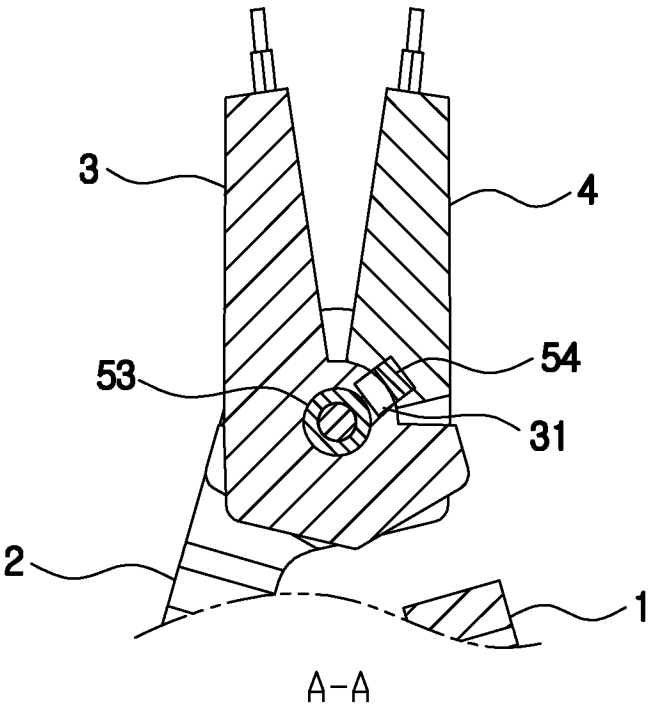
FIG. 9 is a cross sectional view taken along the lines A-A of FIG. 8.
Figure 10:
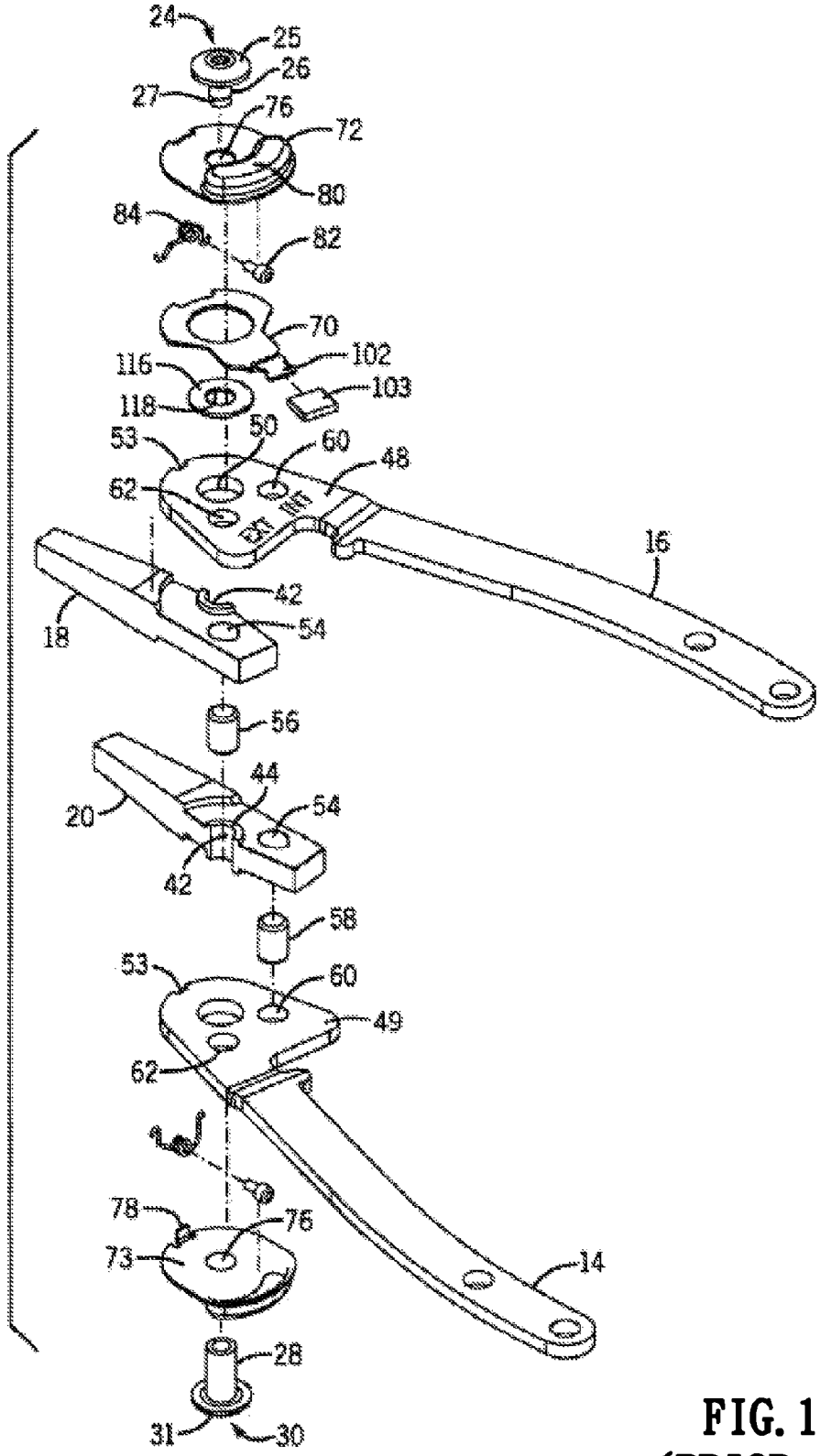
FIG. 10 (PRIOR ART)
FIG. 10 is a perspective view of a conventional C-type pliers.

As shown in FIGS. 3-9, when the C-type pliers is applied in a C ring, the first handle 1 drives the first elongated jaw 3 by matching the first retainer 54 with the first recess 31, the second handle 2 drives the second elongated jaw 4 by matching the second retainer 55 with the fourth recess 42, and the shaft 53 is used as an axle center of the first handle 1, the second handle 2, the first elongated jaw 3, and the second elongated jaw 4 so that the first handle 1 and the second handle 2 drive the first elongated jaw 3 and the second elongated jaw 4, such that the C-type pliers is applicable for an inner diameter of the C ring (as illustrated in FIG. 3). When the C-type pliers is used in an outer diameter of the C ring, the switch bar 513 is switched so that the first inner spring 512 pushes the first retainer 54 to the second recess 41 (as shown in FIG. 6), and the second inner spring 522 pushes the second retainer 55 to the third recess 32 (not shown), then the first handle 1 and the second handle 2 are pressed. After the first recess 31 corresponds to the second recess 41, the first retainer 54 retains in the second recess 41, and the fourth recess 42 corresponds to the third recess 32 synchronously so that the second retainer 55 retains in the third recess 32 (as shown in FIGS. 7-9). In the meantime, the first handle 1 corresponds to the second recess 41 via the first retainer 54 so as to further drive the second elongated jaw 4, and the second handle 2 corresponds to the third recess 32 via the second retainer 55 so as to further drive the first elongated jaw 3. Due to the shaft 53 is the axle center of the first handle 1, the second handle 2, the first elongated jaw 3, and the second elongated jaw 4, the first handle 1 drives the first elongated jaw 3, and the second handle 2 drives the second elongated jaw 4, such that the C-type pliers is applicable for the outer diameter of the C ring.

Thereby, the C-type pliers switches a clamp direction and a unclamp direction of the first elongated jaw 3 and the second elongated jaw 4 quickly by using the switching unit 5 so as to be applicable for the inner diameter and the outer diameter of the C ring, such that the user allows operating a single C-type pliers to clamp or unclamp C ring without using two different types of C-type pliers. In addition, the first cover and the second cover drive the switching unit 5 directly, thus assembling the C-type pliers easily so as to lower production cost further.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A C-type pliers comprising:

a first handle, a second handle, a first elongated jaw, a second elongated jaw, and a switching unit; wherein the first elongated jaw and the second elongated jaw include two lower ends for pivoting with two head ends of the first handle and the second handle;

the first elongated jaw includes a first recess defined on a surface thereof and corresponding to the first handle, the second elongated jaw includes a second recess defined on a surface thereof and corresponding to the first handle, the first elongated jaw also includes a third recess defined on another surface thereof and corresponding to the second handle, the second elongated jaw includes a fourth recess defined on another surface thereof and corresponding to the second handle, such that when the first elongated jaw and the second elongated jaw clamp a workpiece at a certain travel, the first recess communicates with the second recess, and the fourth recess communicates with the third recess;

the first handle includes a first notch formed on a head end thereof so that as the first elongated jaw clamps with the second elongated jaw, the first notch communicates with either or both of the first recess and the second recess, and the second handle includes a second notch formed on a head end thereof so that as the first elongated jaw clamps with the second elongated jaw, the second notch communicates with either or both of the fourth recess and the third recess;

the switching unit includes a first cover for covering the first handle, a second cover for covering the second handle, a shaft extending outwardly from the second cover and used to drive the first cover and the second cover simultaneously, the shaft pivots the first handle, the second handle, the first elongated jaw, and the second elongated jaw;

the switching unit also includes a first retainer, disposed in the first cover, movably inserting through the first notch, and driven by the first cover so as to retain in the first recess or the second recess, the switching unit further includes a second retainer, disposed in the second cover, movably inserting through the second notch, and driven by the second cover so as to retain in the fourth recess or the third recess, when the first retainer retains in the first recess, the second retainer retains in the fourth recess simultaneously, and when the first retainer retains in the second recess, the second retainer retains in the third recess synchronously.

2. The C-type pliers as claimed in claim 1, wherein a spring is mounted between the first handle and the second handle.

3. The C-type pliers as claimed in claim 1, wherein the switching unit also includes a first outer spring and a first inner spring fixed in the first cover, such that a section of the first outer spring is biased against the first retainer as the first cover rotates toward one side by which the first retainer is pushed into the first recess, and a section of the first inner spring is biased against the first retainer as the first cover rotates toward another side by which the first retainer is pushed into the second recess.

* * * * *